US008870307B1

(12) United States Patent
Provenzano et al.

(10) Patent No.: US 8,870,307 B1
(45) Date of Patent: Oct. 28, 2014

(54) READY STATION VANITY AND ENTERTAINMENT SYSTEM

(71) Applicants: Angelo G. Provenzano, Tampa, FL (US); Victor C. Ruz-Rodriguez, Tampa, FL (US)

(72) Inventors: Angelo G. Provenzano, Tampa, FL (US); Victor C. Ruz-Rodriguez, Tampa, FL (US)

( * ) Notice: Subject to any disclaimer, the term of this patent is extended or adjusted under 35 U.S.C. 154(b) by 0 days.

(21) Appl. No.: 13/760,619

(22) Filed: Feb. 6, 2013

(51) Int. Cl.
*A61B 19/00* (2006.01)
*A45D 44/02* (2006.01)

(52) U.S. Cl.
CPC ..... *A45D 44/02* (2013.01)
USPC ..... 312/209; 312/224; 312/279

(58) Field of Classification Search
CPC ..... A47B 81/00; A47B 83/00
USPC ..... 312/209, 224, 225, 226, 227, 237, 278, 312/279, 107, 114
See application file for complete search history.

(56) References Cited

U.S. PATENT DOCUMENTS 1,996,414 A * 4/1935 Gantt ..... 132/315
2,323,290 A * 7/1943 Bagley, Jr. ..... 250/455.11
2,421,342 A * 5/1947 MacKenzie ..... 221/34
3,156,510 A * 11/1964 Hindin et al. ..... 312/223.5
D593,771 S * 6/2009 Petruccelli ..... D6/433
2006/0077654 A1* 4/2006 Krieger et al. ..... 362/136
2008/0088214 A1* 4/2008 Debonis ..... 312/348.4
2009/0121593 A1* 5/2009 Greiner ..... 312/224
2009/0202974 A1* 8/2009 Sohn et al. ..... 434/382
2009/0295110 A1* 12/2009 Wilsher ..... 280/47.35
2011/0062039 A1* 3/2011 Prokop ..... 206/373
2011/0133572 A1* 6/2011 Levi ..... 307/139
2012/0273643 A1* 11/2012 Chang ..... 248/346.06

* cited by examiner

*Primary Examiner* — Daniel Rohrhoff

(57) ABSTRACT

Components of a hair and beauty ready station vanity and entertainment organizing system are combined in a free-standing, self-contained furnishing for use in domestic and commercial settings. The purpose is to allow a user to store and use a wide variety of electric hand-held hair grooming appliances and to provide a power source and convenient storage area for the appliances' electrical power source cords. Included are a lighted mirror; storage area with cabinet and drawers for hair and beauty supplies; placement area for a user to secure, listen, view, and operate electronic portable devices such as audio music players, mobile phones, tablets, and personal computing devices. The electronic portable devices have an audio jack plug and corresponding audio speakers for amplifying the volume outputs.

5 Claims, 4 Drawing Sheets

READY STATION VANITY AND ENTERTAINMENT SYSTEM

BACKGROUND OF THE INVENTION

1. Field of the Invention

The present invention relates to a ready station vanity and entertainment system and more particularly pertains to receiving and supporting a wide variety of grooming and bathroom related objects and audio components.

2. Description of the Prior Art

The use of vanity systems of known designs and configurations is known in the prior art. More specifically, vanity systems of known designs and configurations previously devised and utilized for the purpose of receiving and supporting vanity items are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a ready station vanity and entertainment system that allows receiving and supporting a wide variety of grooming and bathroom related objects and audio components in a safe, convenient and economical manner.

In this respect, the ready station vanity and entertainment system according to the present invention substantially departs from the conventional concepts and designs of the prior art, and in doing so provides an apparatus primarily developed for the purpose of receiving and supporting a wide variety of grooming and bathroom related objects and audio components. One of the unique features is the inclusion of audio components supported by the system allowing the user to conveniently listen to music and/or audio recordings.

Therefore, it can be appreciated that there exists a continuing need for a new and improved ready station vanity and entertainment system which can be used for receiving and supporting a wide variety of grooming and bathroom related objects and audio components. In this regard, the present invention substantially fulfills this need.

SUMMARY OF THE INVENTION

In view of the foregoing disadvantages inherent in the known types of vanity systems of known designs and configurations now present in the prior art, the present invention provides an improved ready station vanity and entertainment system. As such, the general purpose of the present invention, which will be described subsequently in greater detail, is to provide a new and improved ready station vanity and entertainment system and method which has all the advantages of the prior art and none of the disadvantages.

To attain this, the present invention essentially comprises a housing having a top and a bottom, left and right sides separated by a width, a front and a back separated by a depth, and upper and lower and intermediate sections. The upper section has a vertical front face with a depth with a mirror secured to the front face. The lower section has a vertical front face with a depth, speakers mounted in the front face, and a storage space beneath the speakers. The intermediate section is formed at an angle from the horizontal. Grommets are mounted in the intermediate section for removably receiving appliances.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ready station vanity and entertainment system which has all of the advantages of the prior art vanity systems of known designs and configurations and none of the disadvantages.

It is another object of the present invention to provide a new and improved ready station vanity and entertainment system which may be easily and efficiently manufactured and marketed.

It is further object of the present invention to provide a new and improved ready station vanity and entertainment system which is of durable and reliable constructions.

An even further object of the present invention is to provide a new and improved ready station vanity and entertainment system which is susceptible of a low cost of manufacture with regard to both materials and labor, and which accordingly is then susceptible of low prices of sale to the consuming public, thereby making such ready station vanity and entertainment system economically available to the buying public.

Lastly, it is an object of the present invention to provide a new and improved ready station vanity and entertainment system for receiving and supporting a wide variety of grooming and bathroom related objects and audio components, the receiving and supporting being done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
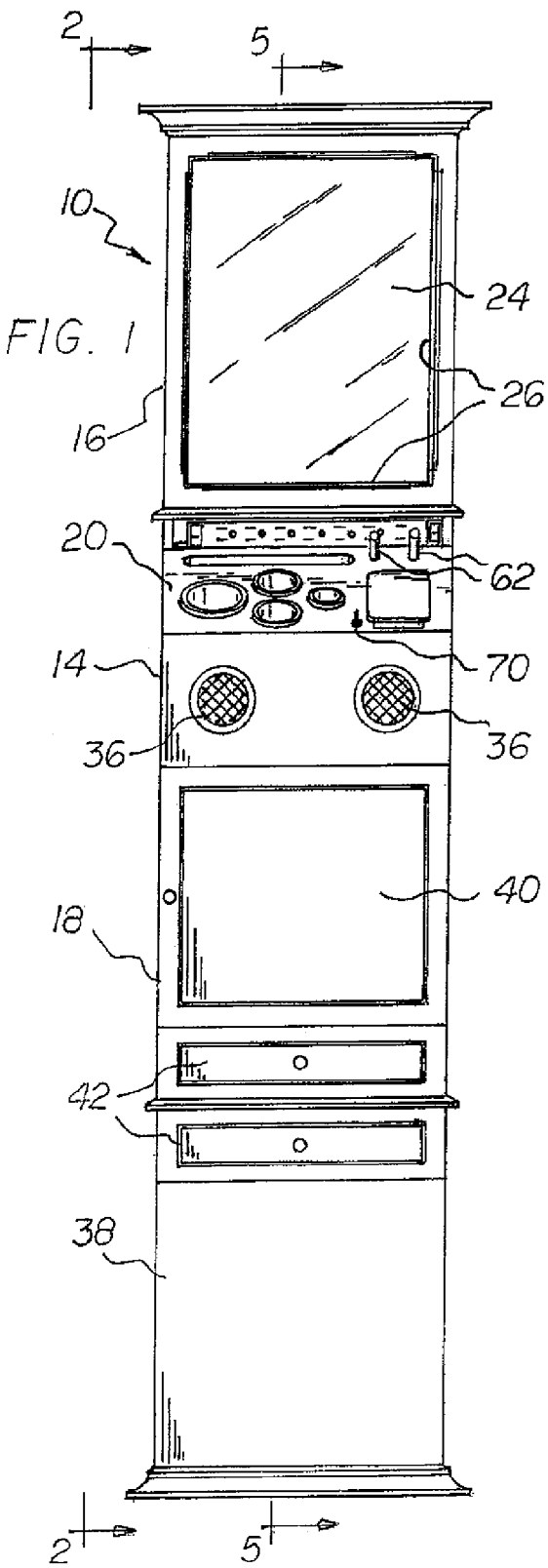
FIG. 1 is a front elevational view of a ready station vanity and entertainment system constructed in accordance with the principles of the present invention.
Figure 2:
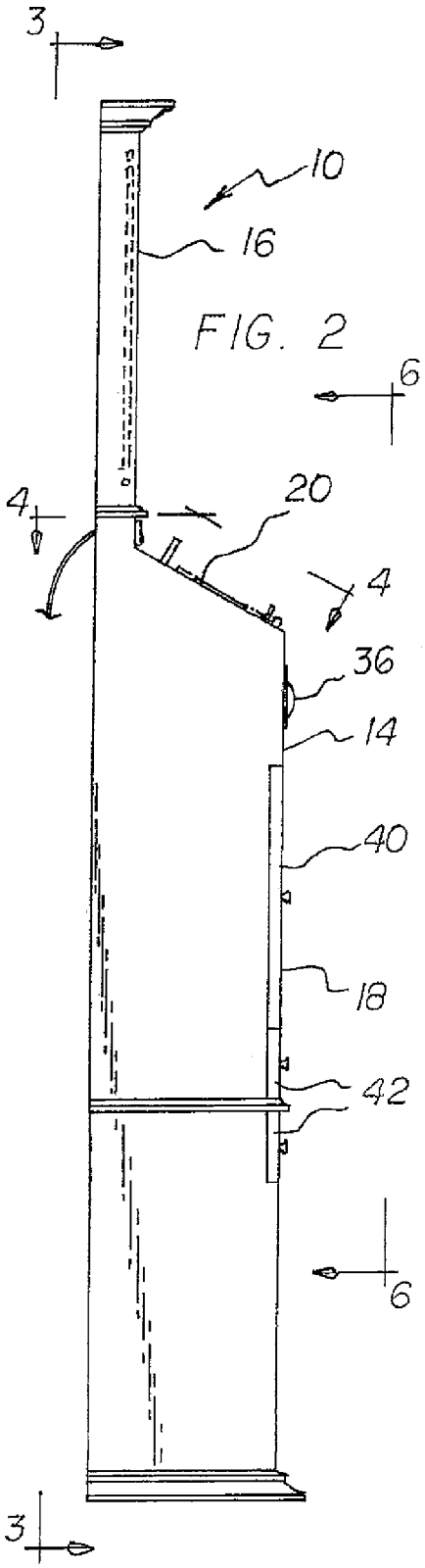
FIG. 2 is a side elevational view taken along line 2-2 of FIG. 1.
Figure 4:
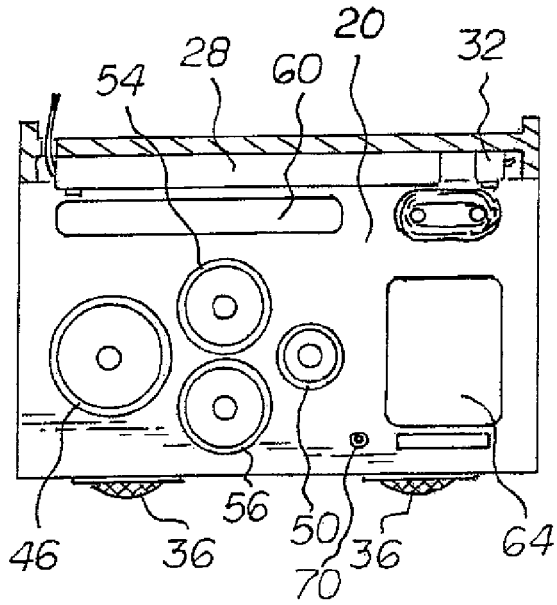
FIG. 4 is an enlarged cross sectional view taken along line 4-4 of FIG. 2.
Figure 3:
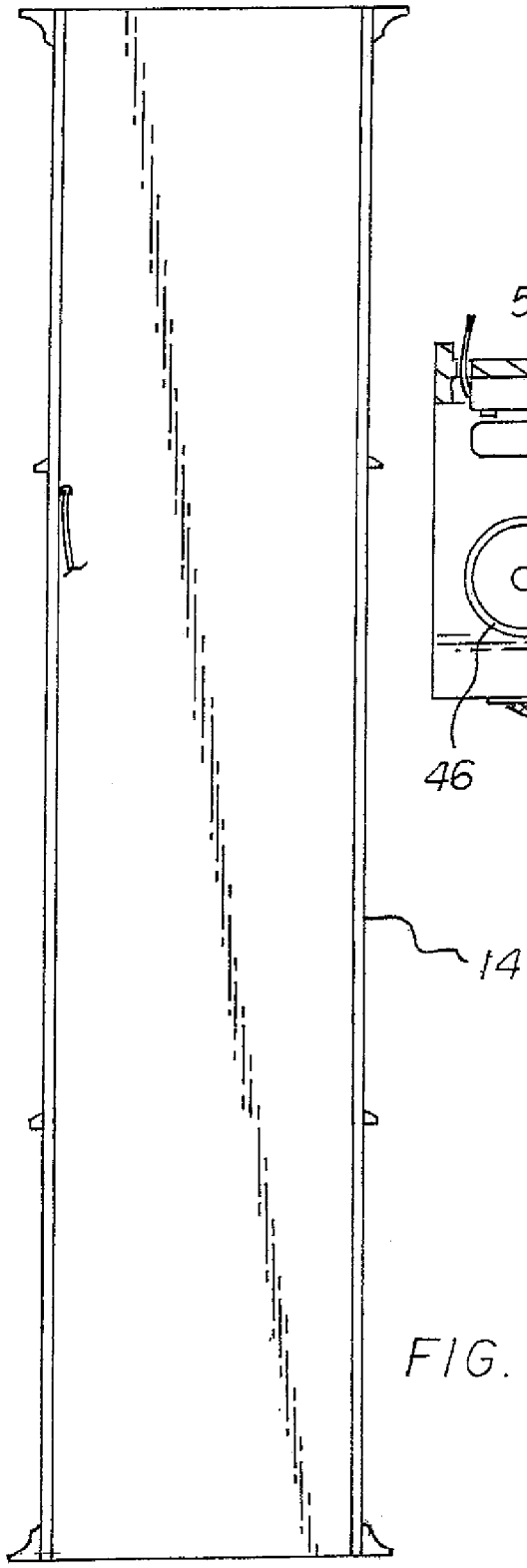
FIG. 3 is a rear elevational view taken along line 3-3 of FIG. 2.
Figure 5:
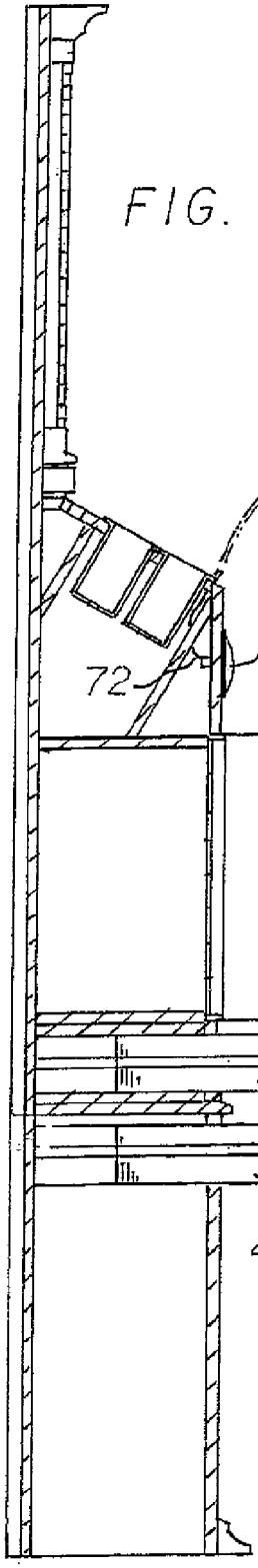
FIG. 5 is an enlarged cross sectional view taken along lime 5-5 of FIG. 1.
Figure 6:
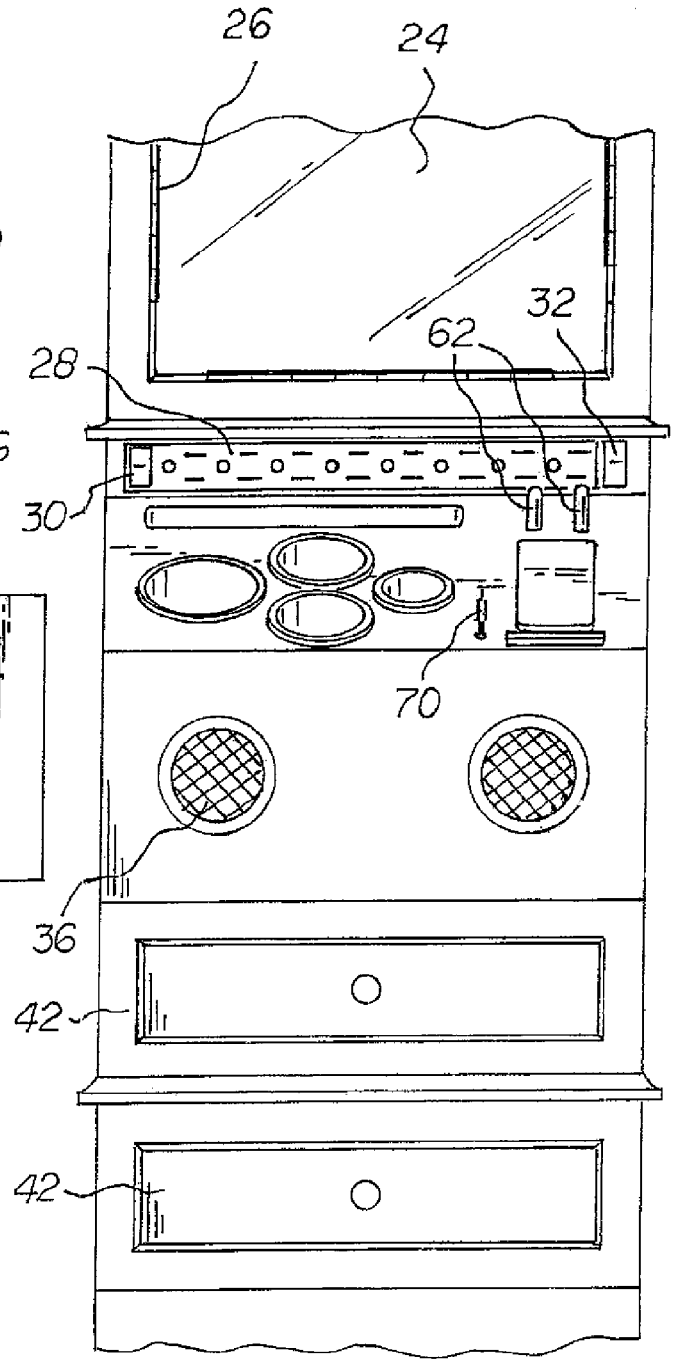
FIG. 6 is an enlarged front elevational view taken along line 6-6 of FIG. 2.
Figure 7:
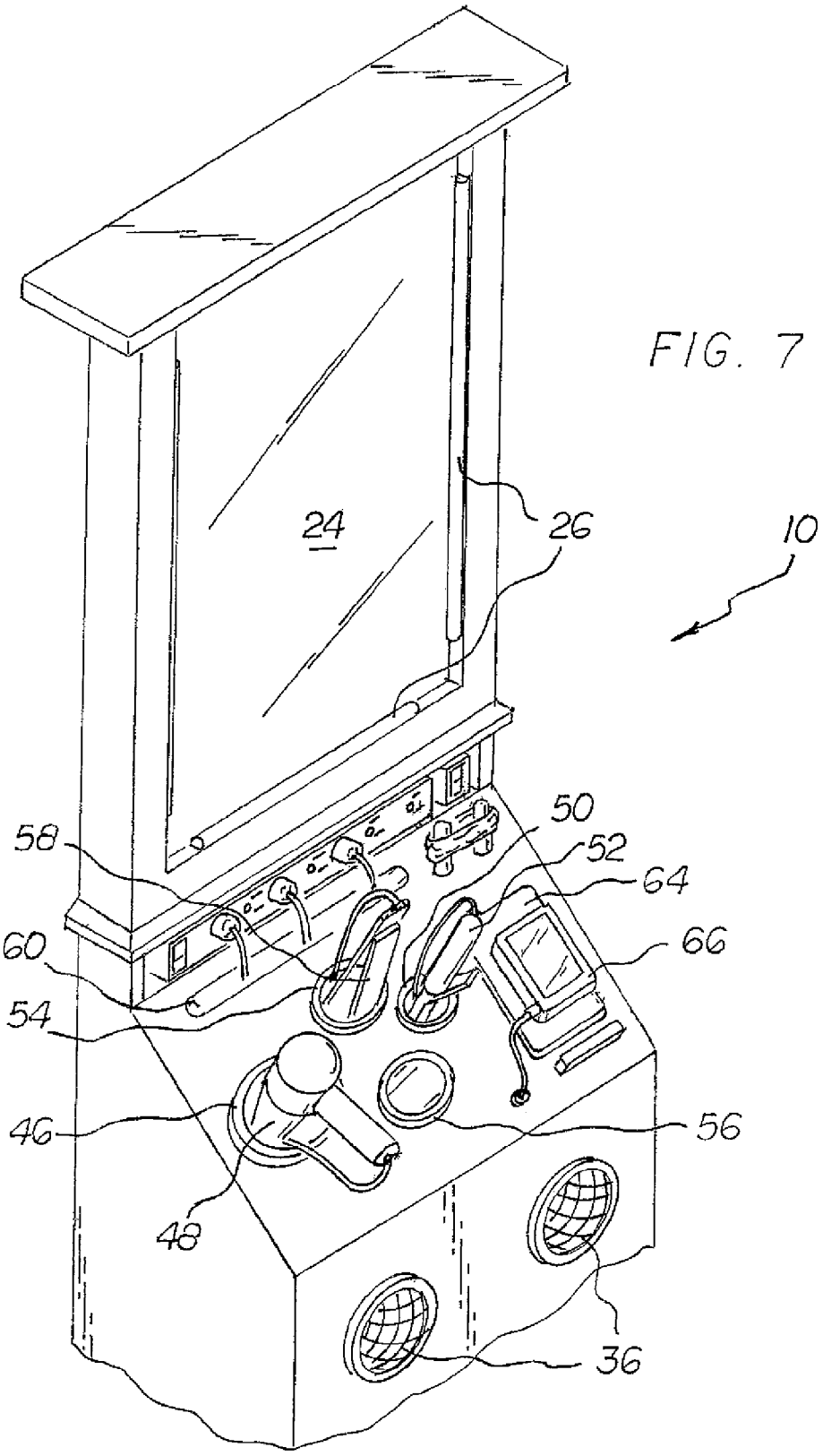
FIG. 7 is a perspective illustration of the upper, intermediate and a portion of the lower section of the system shown in the prior Figures.

With reference now to the drawings, and in particular to FIG. 1 thereof, the preferred embodiment of the new and improved ready station vanity and entertainment system embodying the principles and concepts of the present invention and generally designated by the reference numeral 10 will be described.

The present invention, the ready station vanity and entertainment system 10 is comprised of a plurality of components. Such components in their broadest context include a housing having an upper section, an intermediate section and a lower section. Such components are individually configured and correlated with respect to each other so as to attain the desired objective.

The ready station vanity and entertainment system 10 of the present invention is for receiving and supporting a wide variety of grooming and bathroom related objects and audio components. The receiving and supporting is done in a safe, convenient and economical manner.

First provided is a housing 14 having a horizontal top and a horizontal bottom separated by a height. The housing has a vertical left side and a vertical right side separated by a width. The height is between 4 and 6 times the width. The housing has a front and a back separated by a depth. The housing having an upper section 16 and a lower section 18. The housing also having an intermediate section 20 between the upper and lower sections. The upper section is a height between 50 and 65 percent of the height of the housing. The lower section has a height between 30 and 45 percent of the height of the housing.

The upper section of the housing has a generally vertical front face with a reduced depth. A recessed mirror 24 is secured to the front face of the upper section adjacent to the top of the housing. Peripheral light emitting diode strip lights 26 surround the mirror. Next provided is a horizontally disposed strip of electrical receptacles 28 mounted in the upper section beneath the mirror adjacent to the intermediate section. Next, a first on/off switch 30 is provided to activate and inactivate the electrical receptacles of the power strip. Next, a second on/off switch 32 is provided to activate and inactivate the strip lights. The reduced depth of the upper section is between 10 and 15 percent of the width of the housing.

The lower section has a generally vertical front face with an increased depth. Two laterally spaced speakers 36 are mounted in the front face of the lower section adjacent to the intermediate section. An enclosure 38 encompasses the lower section adjacent to the bottom. A storage cabinet with a door 40 is formed in the upper section beneath the speakers. The storage cabinet is adapted to removably receive hair grooming/styling products. Two storage drawers 42 are slidably received in the front face between the door and the enclosure. The drawers adapted to removably receive makeup, hair accessories, and other beauty items. The increased depth of the lower section is between 60 and 65 percent of the width of the housing.

The intermediate section is formed with a front face in a generally planar configuration at an angle of between 20 and 60 degrees from the horizontal top and bottom. Next provided is a large grommet 46 mounted in the front face of the intermediate section. A hair dryer appliance 48 is removably received in the large grommet. Next provided is a small grommet 50 mounted in the front face of the intermediate section. A hair curling iron appliance 52 is removably received in the small grommet. Next provided are two intermediate grommets 54, 56 mounted in the front face of the intermediate section. A flat iron hair straightener appliance 58 is removably received in one of the intermediate grommets. Next, a hair appliance cord slot 60 is formed in the intermediate section above the grommets and below the upper section. The hair appliance cord slot is adapted to facilitate passage of appliance cords from the appliances to the electrical receptacles. Next provided is a pair of hair elastic repository pegs 58 extending upwardly from the intermediate section laterally spaced from the grommets. Next provided are a neoprene no-slip fabric 64 for docking/placement of an electronic audio device 66 and an electronic audio device stop 68. The no-slip fabric and the audio device stop constitute an electronic audio device docking area. A retractable universal standard audio jack plug 70 with a headphone jack is provided for use with any electronic audio device. Next provided are electrical lines 72 adapted to operatively couple the electronic audio device and the speakers and a supplemental remote audio device.

One of the unique features is the inclusion of audio components supported by the system allowing the user to conveniently listen to music and/or audio recordings.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A ready station vanity and entertainment system comprising:

a housing having a top and a bottom, left and right sides separated by a width, a front and a back separated by multiple depths, and upper and lower and intermediate sections;

the upper section having a vertical front face with a first depth with a mirror secured to the front face;

the lower section having a vertical front face with a second depth, the first depth being less than the second depth, speakers mounted in the front face, and a storage space beneath the speakers;

the intermediate section being formed at an angle from the horizontal, grommets mounted in the intermediate section for removably receiving appliances;

the lower section having a height between 50 and 65 percent of the height of the housing;

the upper section having a height between 30 and 45 percent of the height of the housing;

the intermediate section formed with a front face in a substantially planar configuration at an angle of between 20 and 60 degrees from the horizontal, the lower section being located forwardly of the intermediate section and the upper section being located rearwardly of the intermediate section to thereby facilitate the dissipation of heat from appliances in the grommets; and a single appliance cord slot formed in the intermediate section above the grommets and below the upper section, the hair appliance cord slot adapted to facilitate passage of appliance cords from appliances in the grommets to the electrical receptacles.

2. The system as set forth in claim 1 and further including:

peripheral light emitting diode strip lights surrounding the mirror, a horizontally disposed power strip of electrical receptacles mounted in the upper section beneath the mirror adjacent to the intermediate section, a first on/off switch to activate and inactivate the electrical receptacles of the power strip, a second on/off switch to activate and inactivate the strip lights.

3. The system as set forth in claim 1 and further including:

an enclosure encompassing the lower section adjacent to the bottom;

a storage cabinet with a door formed in the upper section beneath the speakers; and storage drawers slidably received in the front face between the door and the enclosure.

4. The system as set forth in claim 1 and further including:

a pair of hair elastic repository pegs extending upwardly from the intermediate section laterally spaced from the grommets;

a no-slip fabric for docking/placement of an electronic audio device, an electronic audio device stop, and a retractable universal standard audio jack plug.

5. A ready station vanity and entertainment system (10) for receiving and supporting a variety of grooming and bathroom related objects and audio components, the system comprising, in combination:

a housing (14) having a horizontal top and a horizontal bottom separated by a height, the housing having a vertical left side and a vertical right side separated by a width, the height being between 4 and 6 times the width, the housing having a front and a back separated by multiple depths, the housing having an upper section (16) and a lower section (18) and an intermediate section (20) between the upper and lower sections, the lower section having a height between 50 and 65 percent of the height of the housing, the upper section having a height between 30 and 45 percent of the height of the housing;

the upper section having a substantially vertical front face with a first depth, a recessed mirror (24) secured to the front face of the upper section adjacent to the top of the housing, peripheral light emitting diode strip lights (26) surrounding the mirror, a horizontally disposed power strip of electrical receptacles (28) mounted in the upper section beneath the mirror adjacent to the intermediate section, a first on/off switch (30) to activate and inactivate the electrical receptacles of the power strip, a second on/off switch (32) to activate and inactivate the strip lights, the reduced depth of the upper section being between 10 and 15 percent of the width of the housing;

the lower section having a substantially vertical front face with a second depth, the first depth being less than the second depth, two laterally spaced speakers (36) mounted in the front face of the lower section adjacent to the intermediate section, an enclosure (38) encompassing the lower section adjacent to the bottom, a storage cabinet with a door (40) formed in the upper section beneath the speakers, the storage cabinet adapted to removably receive hair grooming/styling products, two storage drawers (42) slidably received in the front face between the door and the enclosure, the drawers adapted to removably receive makeup, hair accessories, and other beauty items, the increased depth of the lower section being between 60 and 65 percent of the width of the housing; and the intermediate section being formed with a front face in a substantially planar configuration at an angle of between 20 and 60 degrees from the horizontal top and bottom, a large grommet (46) mounted in the front face of the intermediate section and a hair dryer appliance (48) removably received in the large grommet, a small grommet (50) mounted in the front face of the intermediate section and a hair curling iron appliance (52) removably received in the small grommet, two intermediate grommets (54) (56) mounted in the front face of the intermediate section and a flat iron hair straightener appliance (58) removably received in one of the intermediate grommets, a hair appliance cord slot (60) formed in the intermediate section above the grommets and below the upper section, the hair appliance cord slot adapted to facilitate passage of appliance cords from the appliances to the electrical receptacles, a pair of hair elastic repository pegs (62) extending upwardly from the intermediate section laterally spaced from the grommets, a neoprene no-slip fabric (64) for docking/placement of an electronic audio device (66), an electronic audio device stop (68), the no-slip fabric and the audio device stop constituting an electronic audio device docking area, a retractable universal standard audio jack plug (70) with a headphone jack for use with any electronic audio device, electrical lines (72) adapted to operatively couple the electronic audio device and the speakers and a supplemental remote audio device.

* * * * *